US008130062B2

(12) United States Patent
Nakamura et al.

(10) Patent No.: US 8,130,062 B2
(45) Date of Patent: Mar. 6, 2012

(54) MICROSTRIPLINE FILTER

(75) Inventors: Soichi Nakamura, Omihachiman (JP); Motoharu Hiroshima, Nomi (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 15 days.

(21) Appl. No.: 12/503,152

(22) Filed: Jul. 15, 2009

(65) Prior Publication Data

US 2009/0273417 A1 Nov. 5, 2009

Related U.S. Application Data

(63) Continuation of application No. PCT/JP2008/059428, filed on May 22, 2008.

(30) Foreign Application Priority Data

Jul. 17, 2007 (JP) ..... 2007-185703

(51) Int. Cl.
*H01P 1/203* (2006.01)
*H01P 7/08* (2006.01)

(52) U.S. Cl. ..... 333/204; 333/219

(58) Field of Classification Search ..... 333/202–205, 333/165–168, 175, 176, 185, 219, 235
See application file for complete search history.

(56) References Cited

U.S. PATENT DOCUMENTS 5,521,564 A 5/1996 Kaneko et al.
5,986,525 A * 11/1999 Sasaki et al. ..... 333/203
6,525,625 B1 2/2003 Tsukamoto et al.

FOREIGN PATENT DOCUMENTS

JP 7-66605 3/1995
JP 8-111602 4/1996
JP 9-8504 1/1997
JP 2001-44708 2/2001

OTHER PUBLICATIONS

PCT/JP2008/059428 International Search Report dated Aug. 8, 2008.
PCT/JP2008/059428 Written Opinion dated Aug. 8, 2008.

* cited by examiner

*Primary Examiner* — Benny Lee
*Assistant Examiner* — Gerald Stevens
(74) *Attorney, Agent, or Firm* — Dickstein Shapiro LLP

(57) ABSTRACT

A microstripline filter that includes principal-surface lines, a ground electrode, and input/output electrodes. A first principal-surface line is capacitively coupled to a second principal-surface line. The second principal-surface line is inductively coupled to a third principal-surface line. The third principal-surface line is capacitively coupled to a fourth principal-surface line. The first through fourth principal-surface lines include open-end-side electrodes, short-circuit-end-side electrodes, and end-opened electrodes. A first pair of the end-opened electrodes are adjacent to each other, whereas a first pair of the short-circuit-end-side electrodes are separate from each other. A second pair of end-opened electrodes are adjacent to each other, whereas a second pair of short-circuit-end-side electrodes are separate from each other.

11 Claims, 3 Drawing Sheets

FIG. 2(A)
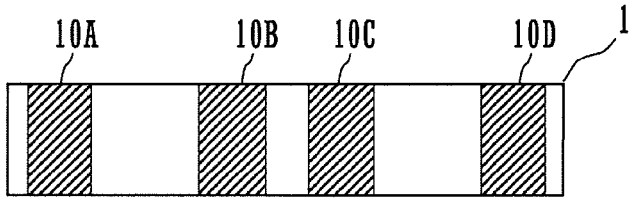
FIG. 2(E)
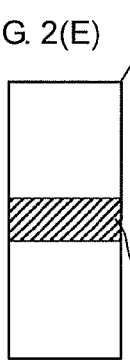
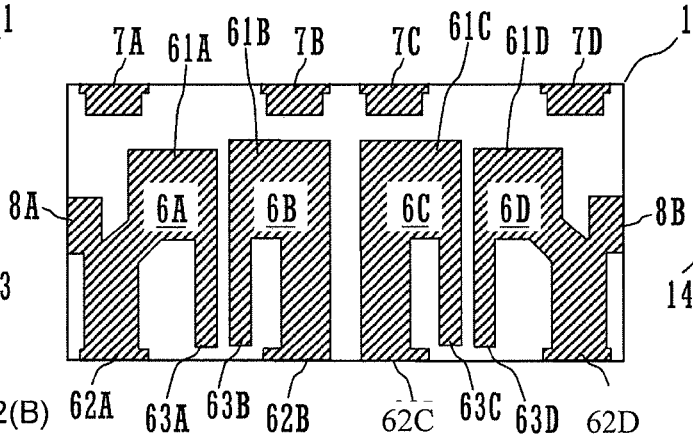
FIG. 2(B)
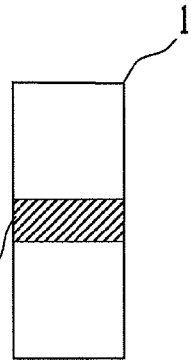
FIG. 2(F)
FIG. 2(C)
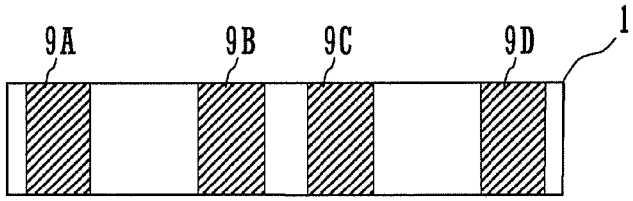
FIG. 2(D)
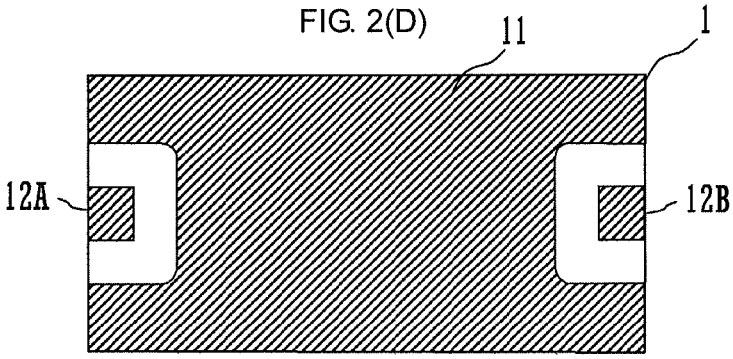

MICROSTRIPLINE FILTER

CROSS REFERENCE TO RELATED APPLICATIONS

The present application is a continuation of International Application No. PCT/JP2008/059428, filed May 22, 2008, which claims priority to Japanese Patent Application No. JP2007-185703, filed Jul. 17, 2007, the entire contents of each of these applications being incorporated herein by reference in their entirety.

FIELD OF THE INVENTION

The present invention relates to a microstripline filter including striplines provided on a dielectric substrate.

BACKGROUND OF THE INVENTION

There have been widespread combline-type microstripline filters in which open ends of striplines constituting quarter-wavelength resonators are unidirectionally placed such that adjacent resonators couple to each other. In the combline-type microstripline filter, each resonant line may have a step structure in which the line width of an open-end-side electrode is different from the line width of a short-circuit-end-side electrode. Also, in the microstripline filter having the step structure, a depressed portion may be provided in an open-end-side electrode so that a short-circuit-end-side electrode extends from the bottom of the depressed portion of the open-end-side electrode to a ground electrode (e.g., see Patent Document 1).

Patent Document 1: Japanese Unexamined Patent Application Publication No. 8-111602

SUMMARY OF THE INVENTION

In radio LAN communication requiring a wideband frequency characteristic in a very high frequency region, a deep attenuation pole may be necessary on a low-frequency side of a frequency band of a microstripline filter. An interdigital-type microstripline filter has been used to realize a wideband frequency characteristic. The interdigital-type microstripline filter has a configuration in which open ends of striplines are alternately oriented and has a feature of very strong coupling in a pair of resonators.

On the other hand, in a conventional combline-type microstripline filter, the coupling in a pair of resonators is not as strong as that of the interdigital-type microstripline filter and thus it is difficult to realize a wideband filter. However, in the combline-type microstripline filter, a plurality of attenuation poles can be set with a high degree of freedom, and using this advantage in radio LAN communication has been demanded.

When a target frequency region is very high as in the microstripline filter for radio LAN communication, a fine electrode pattern is necessary. However, the degree of fineness of the electrode pattern is limited due to constraints in a manufacturing process. For this reason, it is difficult to make a complicated electrode pattern in the microstripline filter for radio LAN communication. For example, a complicated electrode pattern having a depressed portion provided in an open-end-side electrode of a stripline of a step structure and a short-circuit-end-side electrode extending from the bottom of the depressed portion of the open-end-side electrode to a ground electrode cannot be adopted in the microstripline filter for radio LAN communication.

Accordingly, an object of the present invention is to provide a combline-type microstripline filter having a wide passband and having a deep attenuation pole on a low-frequency side of a frequency band, while reducing the degree of fineness of an electrode pattern.

Means for Solving the Problems

A microstripline filter according to the present invention includes a ground electrode, a plurality of resonant lines, and input/output electrodes. The ground electrode is provided on a bottom surface of a rectangular flat dielectric substrate. The plurality of resonant lines constitute a plurality of resonators together with the ground electrode and the dielectric substrate. The input/output electrodes couple to the resonator constituted by any of the plurality of resonant lines.

Any of the resonant lines form a pair of resonators that capacitively couple to each other together with another of the resonant lines. The resonant line includes an open-end-side electrode, an end-opened electrode, and a short-circuit-end-side electrode. The open-end-side electrode is an electrode including an open end of the resonant line. The open-end-side electrode is parallel to a side edge of the other resonant line in the pair. The end-opened electrode is an electrode that extends from an end on a short-circuit-end side of the open-end-side electrode with a line width different from a line width of the open-end-side electrode and that is parallel to the side edge of the other resonant line in the pair together with the open-end-side electrode. The end-opened electrode has an open end. The short-circuit-end-side electrode is an electrode that extends from the end on the short-circuit-end side of the open-end-side electrode to the ground electrode with a line width different from the line width of the open-end-side electrode. A center of the line width of the short-circuit-end-side electrode is displaced in a direction separating from the end-opened electrode.

With this configuration, the open-end-side electrode and the end-opened electrode are parallel to the other resonant line in the pair. Accordingly, a very strong mutual capacitance occurs on the open-end side of the resonant line. Also, the other resonant line in the pair is separated from the short-circuit-end-side electrode, and the end-opened electrode exists therebetween. Accordingly, the mutual capacitance on the short-circuit-end side of the resonant line is significantly small compared to the mutual capacitance on the open-end side. Therefore, the pair of resonators constituted by the resonant lines capacitively couple to each other very strongly compared to the conventional microstripline filter in which combline coupling is performed. Also, an attenuation pole deeply falls on the low-frequency side of the frequency band of the microstripline filter.

Since the center position in the width direction of the short-circuit-end-side electrode is displaced, a large line width of the end-opened electrode can be easily ensured, whereby the degree of fineness of electrode forms can be reduced. Also, the gap between the resonant lines forming a pair can be increased in accordance with the mutual capacitance added by the end-opened electrode, whereby the degree of fineness in an electrode absent portion between the lines can be reduced.

In the microstripline filter according to the present invention, any of the resonant lines includes an open-end-side electrode, an end-opened electrode, and a short-circuit-end-side electrode. This resonant line forms a pair of resonators that capacitively couple to each other together with the resonant line adjacent on the side of the end-opened electrode. Also, this resonant line forms a pair of resonators that inductively couple to each other together with the resonant line adjacent on the side of the short-circuit-end-side electrode.

With this configuration, this resonant line is capable of capacitively coupling to one resonant line adjacent on the side of the end-opened electrode and inductively coupling to the other resonant line adjacent on the side of the short-circuit-end-side electrode. Accordingly, desired attenuation poles can be caused on the high-frequency side and the low-frequency side of the frequency band of the microstripline filter. Since the center position in the width direction of the short-circuit-end-side electrode is displaced, a line width of the end-opened electrode can be easily ensured. Also, the gap between the resonant lines forming a pair of resonators can be increased in accordance with the mutual capacitance added by the end-opened electrode.

A plurality of end capacitance electrodes to give a stray capacitance to the respective resonant lines constituting the pair of resonators that inductively couple to each other may be provided.

An end capacitance is given to the resonant lines constituting the pair of resonators that inductively couple to each other by the end-opened electrodes. The end capacitance functions as a stray capacitance on the resonant lines, and the coupling between the resonators constituted by those resonant lines is biased to inductive coupling.

The respective resonant lines constituting the pair of resonators that capacitively couple to each other may include the open-end-side electrode, the end-opened electrode, and the short-circuit-end-side electrode. In that case, the respective end-opened electrodes face each other preferably. Accordingly, the mutual capacitance increases, so that the coupling between the resonators constituted by the resonant lines is biased to capacitive coupling.

The short-circuit-end-side electrode may extend from a top surface to a side surface of the dielectric substrate. With this configuration, side-surface electrodes function as part of a transmission line, so that the filter can be miniaturized while maintaining the same resonant frequency.

A sum value of the line width of the end-opened electrode and a dimension of a gap between the end-opened electrode and the short-circuit-end-side electrode on one side of the short-circuit-end-side electrode may be larger than 0.5 times of a value calculated by subtracting the line width of the short-circuit-end-side electrode from the line width of the open-end-side electrode. For example, in the microstripline filter described in the above-mentioned Patent Document 1, the width of one side of a step portion is 0.5 times of a value calculated by subtracting the line width of the short-circuit-end-side electrode from the line width of the open-end-side electrode. Compared to this conventional case, the sum value of the line width of the end-opened electrode and the dimension of the gap between the end-opened electrode and the short-circuit-end-side electrode can be larger in the present configuration. Accordingly, the degree of fineness of the electrode pattern can be reduced in the present configuration.

The sum value of the line width of the end-opened electrode and the dimension of the gap between the end-opened electrode and the short-circuit-end-side electrode on one side of the short-circuit-end-side electrode may be larger than 0.5 times of the line width of the open-end-side electrode. Accordingly, the degree of fineness of the electrode pattern can be significantly reduced.

According to the present invention, in a combline-type microstripline filter, a wideband frequency characteristic can be realized and an attenuation pole can be arbitrarily set. Also, an attenuation pole on a low-frequency side of a frequency band can fall more deeply compared to a conventional microstripline filter that performs combline coupling. Furthermore, the degree of fineness of an electrode pattern can be reduced and a good product ratio in a manufacturing process can be increased.

BRIEF DESCRIPTION OF THE DRAWINGS

FIGS. 2(A)-2(F) depict developed views of the microstripline filter.

REFERENCE NUMERALS

Figure 1A:
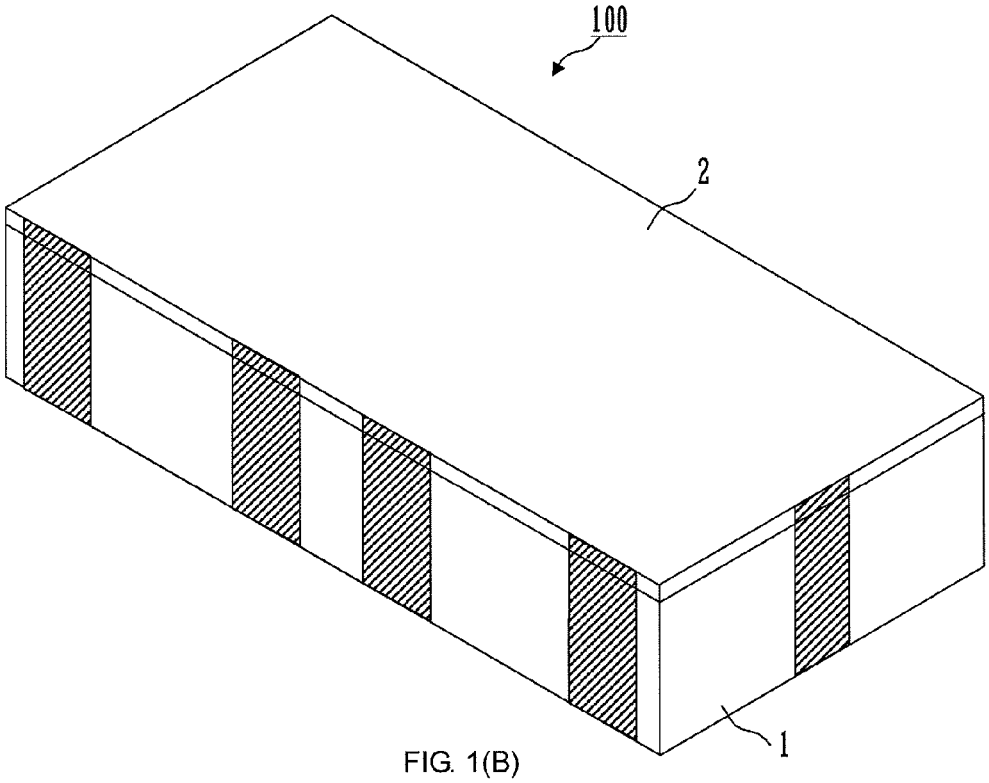
FIGS. 1(A) and 1(B) include perspective views illustrating an example of a microstripline filter.

1 dielectric substrate
2 glass layer
6 principal-surface line
7 end capacitance electrode
8 lead electrode
11 ground electrode
12 input/output electrode
9, 10, 13, and 14 side-surface electrode
61 open-end-side electrode
62 short-circuit-end-side electrode
63 end-opened electrode
100 microstripline filter

DETAILED DESCRIPTION OF THE INVENTION

Hereinafter, an example of the configuration of a microstripline filter is described.

The microstripline filter described here is a bandpass filter. This filter is used in radio LAN facilities in 5 GHz band.

Figure 1B:
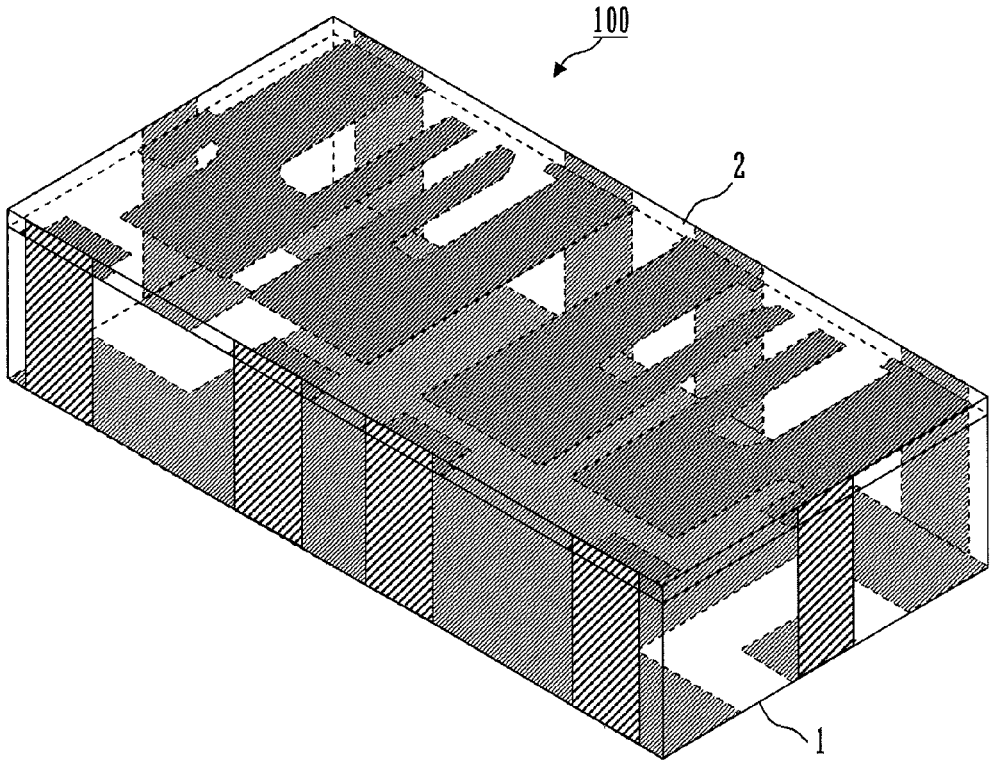

FIG. 1(A) is a perspective view of the microstripline filter. FIG. 1(B) is a transparent perspective view of the microstripline filter.

The microstripline filter 100 includes a dielectric substrate 1 and a glass layer 2. The substrate 1 is a compact rectangular parallelepiped ceramic-sintered substrate that is composed of titanium oxide or the like and that has a relative permittivity of about 111. The composition and dimensions of the substrate 1 may be appropriately set in view of a frequency characteristic and so on.

An electrode pattern is formed on a top surface of the substrate 1. On the top surface side of the substrate 1, the glass layer 2 having a thickness of 15 μm or more is laminated as a protective layer for mechanical protection of the top-surface electrode pattern and for electrical insulation. The glass layer 2 is composed of an insulating material, such as crystalline $SiO_2$ or borosilicate glass. The glass layer 2 is formed by printing and sintering a glass paste. A photosensitive glass paste may be used as a glass paste. Also, the glass layer 2 may be formed by laminating a translucent glass paste and a light-shielding glass paste. With the use of the glass layer 2, the top-surface electrode pattern can be mechanically protected and the resistance to weather can be enhanced.

Alternatively, an electrode can be formed on the top surface side of the glass layer 2. In that case, the glass layer 2 can prevent the top-surface electrode of the glass layer 2 from being short circuited to the top-surface electrode pattern on the dielectric substrate 1. The pattern and dimensions of the glass layer 2 may be appropriately set in view of the degree of adhesion between the dielectric substrate 1 and the glass layer 2, the resistance to environment, a frequency characteristic, and so on.

FIGS. 2(A)-2(F) are a developed view of the dielectric substrate 1. FIG. 2(A) is a front view, FIG. 2(B) is a top view, FIG. 2(C) is a back view, FIG. 2(D) is a bottom view, FIG. 2(E) is a left side view, and FIG. 2(F) is a right side view.

On the top surface of the dielectric substrate 1 illustrated in FIG. 2(B), a top-surface electrode pattern including principal-surface lines 6A to 6D, end capacitance electrodes 7A to 7D, and lead electrodes 8A and 8B is formed. The top-surface electrode pattern is formed of silver electrodes having a thickness of about 6 μm or more. The top-surface electrode pattern is formed by applying a photosensitive silver paste on a mother substrate, forming a pattern by a photolithography process, and performing sintering.

On the front surface of the dielectric substrate 1 illustrated in FIG. 2(A), a side-surface electrode pattern including side-surface electrodes 10A to 10D is formed. On the back surface of the dielectric substrate 1 illustrated in FIG. 2(C), a side-surface electrode pattern including side-surface electrodes 9A to 9D is formed. Those side-surface electrode patterns are formed of silver electrodes having a thickness of about 12 μm or more. The side-surface electrode patterns on the front and back surfaces have similar forms. This is because a printing process is almost the same in the side-surface electrode patterns on the front and back surfaces. By adopting such forms, the necessity of arranging the orientations of the front, back, top, and bottom surfaces of the side-surface electrode patterns can be eliminated in the printing process. Those side-surface electrode patterns are formed by applying a non-photosensitive silver paste on the front and back surfaces of the dielectric substrate 1 by using a screen mask or a metal mask and performing sintering.

The bottom surface of the dielectric substrate 1 illustrated in FIG. 2(D) is a mount surface of the microstripline filter, and a bottom-surface electrode pattern including a ground electrode 11 and input/output electrodes 12A and 12B is formed thereon. The input/output electrodes 12A and 12B are separated from the ground electrode 11. The input/output electrodes 12A and 12B are connected to high-frequency signal input/output terminals when the microstripline filter 100 is mounted on a mount substrate. The ground electrode 11 is a ground surface of resonators and is connected to a ground electrode of the mount substrate. The bottom-surface electrode pattern is formed of silver electrodes having a thickness of about 12 μm. The bottom-surface electrode pattern is formed by applying a non-photosensitive silver paste on the bottom surface of the dielectric substrate 1 by using a screen mask or a metal mask and performing sintering.

On the left surface of the dielectric substrate 1 illustrated in FIG. 2(E), a side-surface electrode pattern including a side-surface electrode 13 is formed. Also, on the right surface of the dielectric substrate 1 illustrated in FIG. 2(F), a side-surface electrode pattern including a side-surface electrode 14 is formed. Those side-surface electrode patterns are formed of silver electrodes having a thickness of about 12 μm or more. The side-surface electrode patterns on the left and right surfaces have similar forms. This is because a printing process is almost the same in the side-surface electrode patterns on the left and right surfaces. By adopting such forms, the necessity of arranging the orientations of the left, right, top, and bottom surfaces of the side-surface electrode patterns can be eliminated in the printing process. Those side-surface electrode patterns are formed by applying a non-photosensitive silver paste on the left and right surfaces of the dielectric substrate 1 by using a screen mask or a metal mask and performing sintering.

In the top-surface electrode pattern illustrated in FIG. 2(B), the principal-surface lines 6A to 6D extend from the boundary of the back surface and the top surface of the dielectric substrate 1 toward the front surface of the dielectric substrate 1. Accordingly, those lines constitute four stages of quarter-wavelength resonators that couple to each other in a combline manner.

The lead electrode 8A has a form bending from the left surface side to the back surface side of the dielectric substrate 1. The lead electrode 8A continues to the principal-surface line 6A on the top surface side of the dielectric substrate 1. The lead electrode 8A continues to the side-surface electrode 13 at the boundary of the left surface and the top surface of the dielectric substrate 1. The side-surface electrode 13 continues to the lead electrode 8A on the top surface side on the left surface of the dielectric substrate 1 and continues to the input/output electrode 12A on the bottom surface side. Accordingly, the lead electrode 8A allows tap-coupling between the input/output electrode 12A and the resonator constituted by the principal-surface line 6A.

The principal-surface line 6A includes an open-end-side electrode 61A, a short-circuit-end-side electrode 62A, and an end-opened electrode 63A. The open-end-side electrode 61A is a rectangular electrode that is open on the front surface side of the dielectric substrate 1, that continues to the short-circuit-end-side electrode 62A at the corner on the back surface side and the left surface side, and that continues to the end-opened electrode 63A at the corner on the back surface side and the right surface side. The end-opened electrode 63A extends from the edge on the back surface side of the open-end-side electrode 61A toward the back surface side of the dielectric substrate 1, and the end on the back surface side of the end-opened electrode 63A is open. The short-circuit-end-side electrode 62A continues to the open-end-side electrode 61A on the front surface side, the vicinity of the center connects to the lead electrode 8A, and continues to the side-surface electrode 9A at the boundary of the back surface and the top surface of the dielectric substrate 1. The line width of the short-circuit-end-side electrode 62A is smaller than that of the open-end-side electrode 61A, whereby the principal-surface line 6A has a step structure. The side-surface electrode 9A continues to the short-circuit-end-side electrode 62A on the top surface side and continues to the ground electrode 11 at the boundary of the back surface and the bottom surface of the dielectric substrate 1 on the bottom surface side. Accordingly, the principal-surface line 6A faces the ground electrode 11 via the dielectric substrate 1 and is brought into conduction with the ground electrode 11 via the side-surface electrode 9A. Accordingly, the principal-surface line 6A constitutes a quarter-wavelength resonator in an input stage (or output stage).

The principal-surface line 6B includes an open-end-side electrode 61B, a short-circuit-end-side electrode 62B, and an end-opened electrode 63B. The open-end-side electrode 61B is a rectangular electrode that is open on the front surface side of the dielectric substrate 1, that continues to the short-circuit-end-side electrode 62B on the right surface side of the edge on the back surface side, and that continues to the end-opened electrode 63B on the left surface side of the edge on the back surface side. The end-opened electrode 63B extends from the edge on the back surface side of the open-end-side electrode 61B toward the back surface side of the dielectric substrate 1, and the end on the back surface side of the end-opened electrode 63B is open. The short-circuit-end-side electrode 62B continues to the open-end-side electrode 61B on the front surface side, and continues to the side-surface electrode 9B at the boundary of the back surface and the top surface of the dielectric substrate 1. The line width of the short-circuit-end-side electrode 62B is smaller than that of the open-end-side electrode 61B, whereby the principal-surface line 6B has a step structure. The side-surface electrode 9B continues to the short-circuit-end-side electrode 62B on the top surface side and continues to the ground electrode 11 at the boundary of the back surface and the bottom surface of the dielectric substrate 1. Accordingly, the principal-surface line 6B faces the ground electrode 11 via the dielectric substrate 1 and is brought into conduction with the ground electrode 11 via the side-surface electrode 9B. Accordingly, the principal-surface line 6B constitutes a quarter-wavelength resonator in a second stage.

The open-end-side electrode 61A and the end-opened electrode 63A of the principal-surface line 6A and the open-end-side electrode 61B and the end-opened electrode 63B of the principal-surface line 6B are parallel to each other and face each other with a predetermined gap of an electrode absent portion therebetween. Accordingly, a large mutual capacitance is given to the open-end side between the resonator constituted by the principal-surface line 6A and the resonator constituted by the principal-surface line 6B. The end-opened electrode 63A and the end-opened electrode 63B exist between the short-circuit-end-side electrode 62A of the principal-surface line 6A and the short-circuit-end-side electrode 62B of the principal-surface line 6B. Accordingly, a mutual capacitance is hardly given to the short-circuit-end side between the resonator constituted by the principal-surface line 6A and the resonator constituted by the principal-surface line 6B. Therefore, these resonators capacitively couple to each other. This capacitive coupling causes an attenuation pole to fall on the low frequency side of the frequency band of the microstripline filter 100.

The principal-surface line 6C includes an open-end-side electrode 61C, a short-circuit-end-side electrode 62C, and an end-opened electrode 63C. The principal-surface line 6C has a form similar to that of the principal-surface line 6B, but the orientation on the right surface side and the left surface side is inverted. The short-circuit-end-side electrode 62C continues to the side-surface electrode 9C at the boundary of the back surface and the top surface of the dielectric substrate 1. The side-surface electrode 9C continues to the short-circuit-end-side electrode 62C on the top surface side and continues to the ground electrode 11 at the boundary of the back surface and the bottom surface of the dielectric substrate 1 on the bottom surface side. The principal-surface line 6C constitutes a quarter-wavelength resonator in a third stage.

The open-end-side electrode 61B and the short-circuit-end-side electrode 62B of the principal-surface line 6B and the open-end-side electrode 61C and the short-circuit-end-side electrode 62C of the principal-surface line 6C are parallel to each other and face each other with a predetermined gap of an electrode absent portion therebetween. Accordingly, a mutual capacitance is evenly given from the open-end side to the short-circuit-end side between the resonator constituted by the principal-surface line 6B and the resonator constituted by the principal-surface line 6C. Additionally, the ends on the front surface side of the open-end-side electrodes 61B and 61C face end capacitance electrodes 7B and 7C described below. The end capacitance electrodes 7B and 7C continue to the ground electrode 11 via side-surface electrodes 10B and 10C. Therefore, an end capacitance is added to the open-end-side electrodes 61B and 61C. The end capacitance functions as a stray capacitance in the resonators, and the resonators inductively couple to each other. This inductive coupling causes an attenuation pole to fall on the high frequency side of the frequency band of the microstripline filter 100.

The principal-surface line 6D includes an open-end-side electrode 61D, a short-circuit-end-side electrode 62D, and an end-opened electrode 63D. The principal-surface line 6D has a form similar to that of the principal-surface line 6A, but the orientation on the right surface side and the left surface side is inverted. The short-circuit-end-side electrode 62D continues to the lead electrode 8B at the vicinity of the center and continues to the side-surface electrode 9D at the boundary of the back surface and the top surface of the dielectric substrate 1. The side-surface electrode 9D continues to the short-circuit-end-side electrode 62D on the top surface side and continues to the ground electrode 11 at the boundary of the back surface and the bottom surface of the dielectric substrate 1 on the bottom surface side. Therefore, the principal-surface line 6D constitutes a quarter-wavelength resonator in an output stage (or input stage). The principal-surface line 6D and the above-described principal-surface line 6C constitute a pair of resonators that capacitively couple to each other. This capacitive coupling causes a second attenuation pole to fall on the low frequency side of the frequency band of the microstripline filter 100.

The lead electrode 8B has a form similar to that of the lead electrode 8A, but the orientation on the right surface side and the left surface side is inverted. The lead electrode 8B continues to the principal-surface line 6D on the back surface side of the dielectric substrate 1. The lead electrode 8B continues to the side-surface electrode 14 at the boundary of the right surface and the top surface of the dielectric substrate 1. The side-surface electrode 14 continues to the lead electrode 8B on the top surface side of the right surface of the dielectric substrate 1 and continues to the input/output electrode 12B on the bottom surface side. Accordingly, the lead electrode 8B allows tap-coupling between the input/output electrode 12B and the resonator constituted by the principal-surface line 6D.

The end capacitance electrodes 7A to 7D have forms similar to each other, continue to the side-surface electrodes 10A to 10D at the boundary of the front surface and the top surface of the dielectric substrate 1, and their ends on the back surface side are open. The end capacitance electrodes 7A to 7D are separated from the open ends of the principal-surface lines 6A to 6D by a predetermined gap. Accordingly, the end capacitance electrodes 7A to 7D give an end capacitance to the principal-surface lines 6A to 6D. The value of the end capacitance depends on the dimension of the gap and the facing length between the end capacitance electrodes 7A to 7D and the principal-surface lines 6A to 6D. The frequency characteristic can be adjusted by adjusting the gap and the facing length.

The entire end portions of the end capacitance electrodes 7B and 7C face the principal-surface lines 6B and 6C. Therefore, the end capacitance given to the principal-surface lines 6B and 6C by the end capacitance electrodes 7B and 7C is very large, so that the coupling between the principal-surface lines 6B and 6C is biased to inductive coupling.

On the other hand, the centers in the horizontal direction in the figure of the end capacitance electrodes 7A and 7D are significantly displaced from the centers in the horizontal direction in the figure of the principal-surface lines 6A and 6D, and only parts of the end portions of the end capacitance electrodes 7A and 7D face the principal-surface lines 6A and 6D. Therefore, the end capacitance given to the principal-surface lines 6A and 6D by the end capacitance electrodes 7A and 7D is very small, and the mutual capacitance on the open end side between the principal-surface lines 6A and 6B and the mutual capacitance on the open end side between the principal-surface lines 6C and 6D keep the coupling between the principal-surface lines 6A and 6B and the coupling between the principal-surface lines 6C and 6D biased to capacitive coupling.

The end capacitance electrodes 7A and 7D and the side-surface electrodes 10A and 10D need not always be provided. However, it is preferable to provide the end capacitance electrodes 7A and 7D in the case where the side-surface electrodes 10A and 10D are provided to form similar side-surface electrode patterns. For example, in the case where only the side-surface electrodes 10A and 10D are provided with the end capacitance electrodes 7A and 7D not being provided, an end capacitance is given to the principal-surface lines 6A and 6D by the side-surface electrodes 10A and 10D. The end capacitance easily varies depending on a cut error and so on of the dielectric substrate, which leads to a risk of affecting stability of the frequency characteristic of the microstripline filter 100. On the other hand, in the case where the end capacitance electrodes 7A and 7D are provided, the end capacitance given to the principal-surface lines 6A and 6D by the end capacitance electrodes 7A and 7D is stable even if the dielectric substrate has a cut error, which contributes to the stability of the frequency characteristic of the microstripline filter 100.

With the above-described configuration, the microstripline filter 100 constitutes a filter including four stages of resonators. Specifically, the input/output electrode 12A achieves tap-coupling to the resonator constituted by the principal-surface line 6A. The resonator constituted by the principal-surface line 6A capacitively couples to the resonator constituted by the principal-surface line 6B. The resonator constituted by the principal-surface line 6B inductively couples to the resonator constituted by the principal-surface line 6C. The resonator constituted by the principal-surface line 6C capacitively couples to the resonator constituted by the principal-surface line 6D. The input/output electrode 12B achieves tap-coupling to the resonator constituted by the principal-surface line 6D.

When capacitive coupling between adjacent resonators is discussed, it is necessary to discuss a difference in resonant frequency between an odd mode where an electric wall exists at the center between the resonators and an even mode where a magnetic wall exists at the center between the resonators. When the principal-surface lines 6A to 6D have a step structure, the resonant frequency in the even mode is lower than the resonant frequency in the odd mode in each principal-surface line. Accordingly, the resonant frequency in the even mode is higher than the resonant frequency in the odd mode, so that a stronger capacitive coupling can be obtained.

Furthermore, the capacitive coupling among the resonators is strengthened also by the end-opened electrodes 63A to 63D of the respective principal-surface lines 6A to 6D. Providing the end-opened electrodes 63A and 63B causes the resonator length in the odd mode to be very long and the resonant frequency in the odd mode to be significantly low. On the other hand, the resonator length in the even mode slightly becomes long, but the degree of extension is small, and the resonant frequency in the even mode becomes low only slightly. Therefore, the resonant frequency in the even mode is higher than the resonant frequency in the odd mode, and thus stronger capacitive coupling can be obtained.

Also, since the short-circuit-end-side electrodes 62A to 62D and the end-opened electrodes 63A to 63D continue to the ends on the back surface side of the open-end-side electrodes 61A to 61D in the principal-surface lines 6A to 6D, respectively, each line width can be a little smaller than half of the line width of the open-end-side electrodes 61A to 61D. Accordingly, the degree of fineness of the top-surface electrode pattern can be reduced.

For example, in the above-described microstripline filter according to Patent Document 1, the width of one side of the step portion is half of the difference between the line width on the open-end side and the line with on the short-circuit-end side.

However, in this configuration, the width of one side of the step portion: the sum value of the dimension of the gap between the short-circuit-end-side electrode 62A and the end-opened electrode 63A and the line width of the end-opened electrode 63A, can be more than half of the value calculated by subtracting the line width of the short-circuit-end-side electrode 62A from the line width of the open-end-side electrode 61A. Furthermore, it is even possible that the sum value is larger than 0.5 times the line width of the open-end-side electrode 61A. Accordingly, the degree of fineness of the top-surface electrode pattern can be reduced.

The top-surface electrode pattern provided on the top surface of the dielectric substrate 1 has a large influence on the frequency characteristic of the microstripline filter depending on its form and precision, and is thus formed in a photolithography process by improving the electrode precision as much as possible.

Furthermore, since the electrode thickness of the side-surface electrode pattern is larger than the electrode thickness of the top-surface electrode pattern, the current in a portion on the ground-end side where a current typically concentrates is dispersed so as to reduce conductor loss. With this configuration, the microstripline filter serves as a device with a small insertion loss.

Next, an example of a frequency characteristic of the microstripline filter determined by simulation is described.

Figure 3A:
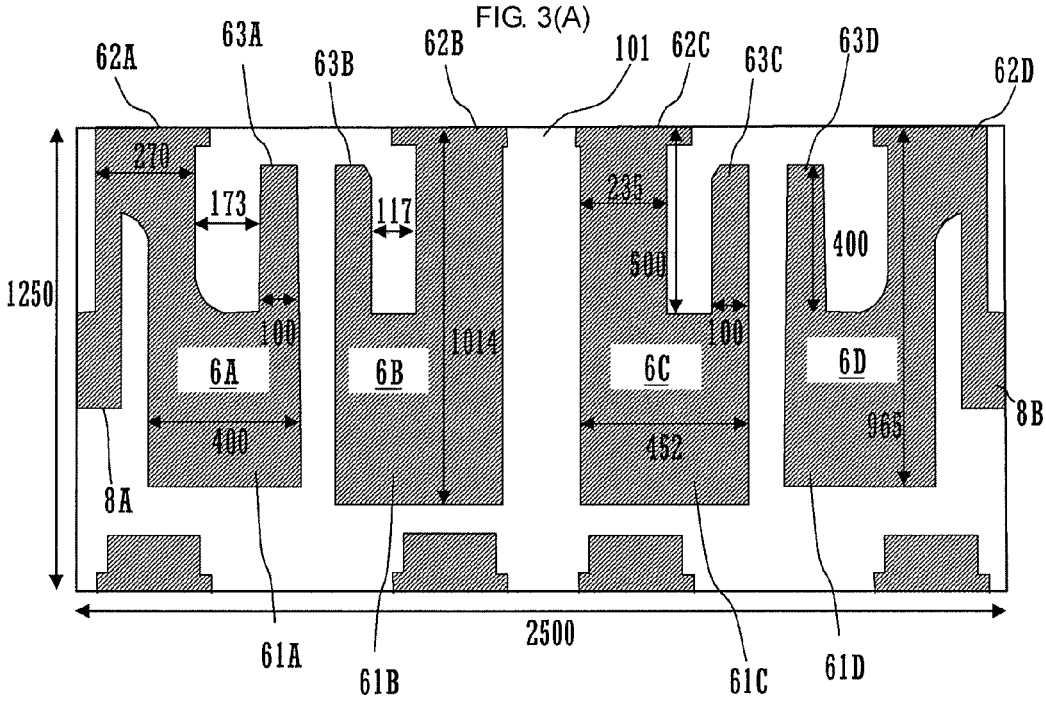
FIG. 3(A) is a diagram illustrating the dimension of respective parts of a microstripline filter used in the simulation depicted in FIG. 3(B).
Figure 3B:
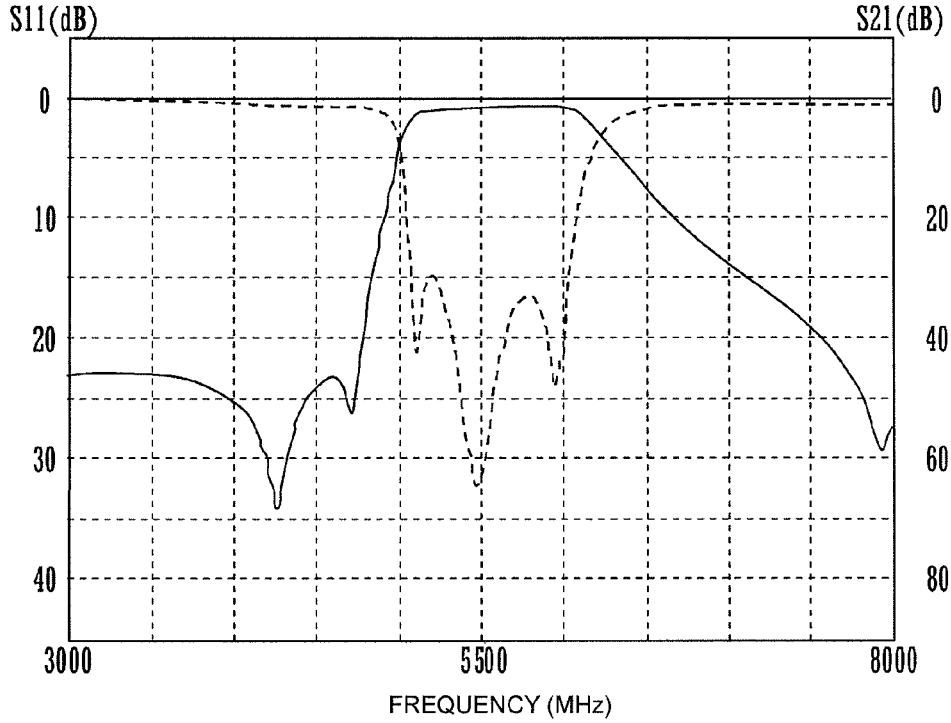
FIG. 3(B) is a graph showing a frequency characteristic of the microstripline filter based on simulation.

FIG. 3(A) is a diagram illustrating the dimensions of respective parts of a microstripline filter 101 used in the simulation. In the figure, the parts same as those in the above-described microstripline filter 100 are denoted by the same reference numerals. The unit of the dimensions shown in the figure is μm (micrometer). FIG. 3(B) is a graph showing the frequency characteristic of the microstripline filter 101 obtained through the simulation. The broken line shown in the graph indicates characteristic S11 of the microstripline filter 101. The solid line shown in the graph indicates characteristic S21 of the microstripline filter 101.

When attention is focused on characteristic S21 of the microstripline filter 101, the microstripline filter 101 realizes a passband with an insertion loss of about −2 dB from about 5100 MHz to about 5900 MHz. Also, two attenuation poles exist at the vicinity of about 4200 MHz to about 4800 MHz on the low-frequency side in the passband, and the attenuation amount in the region of 4600 GHz or less is about −40 dB or less.

In this configuration, the end-opened electrodes 63A and 63B strengthen the capacitive coupling in the pair of resonators of the principal-surface lines 6A and 6B, and the end-opened electrodes 63C and 63D strengthen the capacitive coupling in the pair of resonators of the principal-surface lines 6C and 6D. Accordingly, the two attenuation poles on the low-frequency side of the passband deeply fall with an attenuation amount of about −40 dB or less. Furthermore, the inductive coupling in the pair of resonators of the principal-surface lines 6B and 6C causes the high-frequency side of the passband to fall relatively abruptly.

The position and form of the principal-surface lines and the side-surface electrodes in the above-described configuration example are based on product specifications, and any position and form may be adopted based on product specifications. The present invention can be applied to a configuration other than the above-described configuration, and can be adopted to various pattern forms of filter devices. Furthermore, another configuration (high-frequency circuit) may be provided in this filter device.

The invention claimed is:

1. A microstripline filter comprising:

a dielectric substrate;

a ground electrode provided on a first surface of the dielectric substrate;

a plurality of resonant lines formed on a second surface of the dielectric substrate, the second surface being opposite the first surface, the plurality of resonant lines constituting a plurality of resonators together with the ground electrode and the dielectric substrate; and an input/output electrode coupled to a resonator of the plurality of resonators, wherein the plurality of resonant lines form at least one pair of resonators that are capacitively coupled to each other, wherein at least one of the resonant lines includes (1) an open-end-side electrode having an open end that is parallel to a side edge of a second resonant line in the at least one pair of resonators, the open-end-side electrode having a first line length and a first line width, the first line width being smaller than the first line length; (2) an end-opened electrode that extends from an end on a short-circuit-end side of the open-end-side electrode, the end-opened electrode having a second line length and a second line width, the second line width being smaller than the second line length, the second line width being different from the first line width of the open-end-side electrode, the end-opened electrode being parallel to the side edge of the second resonant line in the at least one pair of resonators, and the end-opened electrode having an open end; and (3) a short-circuit-end-side electrode that extends from the end on the short-circuit-end side of the open-end-side electrode to the ground electrode, the short-circuit-end-side electrode having a third line length and a third line width, the third line width being smaller than the third line length, the third line width being different from the first line width of the open-end-side electrode, a center of the third line width of the short-circuit-end-side electrode being displaced in a direction separating from the end-opened electrode, and wherein the second line width of the end-opened electrode is different from the third line width of the short-circuit-end-side electrode along an entire length of the end-opened electrode, and the third line width of the short-circuit-end-side electrode is smaller than the first line width of the open-end-side electrode.

2. The microstripline filter according to claim 1, wherein the respective resonant lines constituting the at least one pair of resonators that are capacitively coupled to each other include the open-end-side electrode, the end-opened electrode, and the short-circuit-end-side electrode, the respective end-opened electrodes facing each other.

3. The microstripline filter according to claim 1, wherein the short-circuit-end-side electrode extends from a top surface to a side surface of the dielectric substrate.

4. A microstripline filter comprising:

a dielectric substrate;

a ground electrode provided on a first surface of the dielectric substrate;

a plurality of resonant lines formed on a second surface of the dielectric substrate, the second surface being opposite the first surface, the plurality of resonant lines constituting a plurality of resonators together with the ground electrode and the dielectric substrate; and an input/output electrode coupled to a resonator of the plurality of resonators, wherein the plurality of resonant lines form at least one pair of resonators that are capacitively coupled to each other, wherein at least one of the resonant lines includes (1) an open-end-side electrode having an open end that is parallel to a side edge of a second resonant line in the at least one pair of resonators; (2) an end-opened electrode that extends from an end on a short-circuit-end side of the open-end-side electrode with a line width different from a line width of the open-end-side electrode, the end-opened electrode being parallel to the side edge of the second resonant line in the at least one pair of resonators, and the end-opened electrode having an open end; and (3) a short-circuit-end-side electrode that extends from the end on the short-circuit-end side of the open-end-side electrode to the ground electrode with a line width different from the line width of the open-end-side electrode, a center of the line width of the short-circuit-end-side electrode being displaced in a direction separating from the end-opened electrode, wherein the line width of the end-opened electrode is different from the line width of the short-circuit-end-side electrode along an entire length of the end-opened electrode, and wherein a sum value of the line width of the end-opened electrode and a dimension of a gap between the end-opened electrode and the short-circuit-end-side electrode on one side of the short-circuit-end-side electrode is larger than 0.5 times of a value calculated by subtracting the line width of the short-circuit-end-side electrode from the line width of the open-end-side electrode.

5. The microstripline filter according to claim 4, wherein the sum value of the line width of the end-opened electrode and the dimension of the gap between the end-opened electrode and the short-circuit-end-side electrode on one side of the short-circuit-end-side electrode is larger than 0.5 times of the line width of the open-end-side electrode.

6. A microstripline filter comprising:

a dielectric substrate;

a ground electrode provided on a first surface of the dielectric substrate;

a plurality of resonant lines formed on a second surface of the dielectric substrate, the second surface being opposite the first surface, the plurality of resonant lines constituting a plurality of resonators together with the ground electrode and the dielectric substrate; and an input/output electrode coupled to a resonator of the plurality of resonators, wherein at least one of the plurality of resonant lines includes (1) an open-end-side electrode having an open end that is parallel to side edges of an adjacent resonant line of the plurality of resonant lines, the open-end-side electrode having a first line length and a first line width, the first line width being smaller than the first line length; (2) an end-opened electrode that extends from an end on a short-circuit-end side of the open-end-side electrode, the end-opened electrode having a second line length and a second line width, the second line width being smaller than the second line length, the second line width being different from the first line width of the open-end-side electrode, the end-opened electrode being parallel to the side edge of the adjacent resonant line, and the end-opened electrode having an open end;

and (3) a short-circuit-end-side electrode that has a center of the line width thereof displaced in a direction separating from the end-opened electrode, the short-circuit-end-side electrode extending from the end on the short-circuit-end side of the open-end-side electrode to the ground electrode, the short-circuit-end-side electrode having a third line length and a third line width, the third line width being smaller than the third line length, the third line width being different from the first line width of the open-end-side electrode, and the short-circuit-end-side electrode being parallel to the side edge of the adjacent resonant line, wherein a first pair of resonators of the plurality of resonators are capacitively coupled to each other on the side of the end-opened electrode of the at least one of the plurality of resonant lines, and a second pair of resonators of the plurality of resonators are inductively coupled to each other, the first pair of resonators including the at least one of the plurality of resonant lines, and wherein the second line width of the end-opened electrode is different from the third line width of the short-circuit-end-side electrode along an entire length of the end-opened electrode, and the third line width of the short-circuit-end-side electrode is smaller than the first line width of the open-end-side electrode.

7. The microstripline filter according to claim 6, further comprising:

a plurality of end capacitance electrodes arranged to give a stray capacitance to the respective resonant lines constituting the second pair of resonators that are inductively coupled to each other.

8. The microstripline filter according to claim 6, wherein the respective resonant lines constituting the first pair of resonators that are capacitively coupled to each other include the open-end-side electrode, the end-opened electrode, and the short-circuit-end-side electrode, the respective end-opened electrodes facing each other.

9. The microstripline filter according to claim 6, wherein the short-circuit-end-side electrode extends from a top surface to a side surface of the dielectric substrate.

10. A microstripline filter comprising:

a dielectric substrate;

a ground electrode provided on a first surface of the dielectric substrate;

a plurality of resonant lines formed on a second surface of the dielectric substrate, the second surface being opposite the first surface, the plurality of resonant lines constituting a plurality of resonators together with the ground electrode and the dielectric substrate; and an input/output electrode coupled to a resonator of the plurality of resonators, wherein at least one of the plurality of resonant lines includes (1) an open-end-side electrode having an open end that is parallel to side edges of an adjacent resonant line of the plurality of resonant lines; (2) an end-opened electrode that extends from an end on a short-circuit-end side of the open-end-side electrode with a line width different from a line width of the open-end-side electrode, the end-opened electrode being parallel to the side edge of the adjacent resonant line, and the end-opened electrode having an open end; and (3) a short-circuit-end-side electrode that has a center of the line width thereof displaced in a direction separating from the end-opened electrode, the short-circuit-end-side electrode extending from the end on the short-circuit-end side of the open-end-side electrode to the ground electrode with a line width different from the line width of the open-end-side electrode, and the short-circuit-end-side electrode being parallel to the side edge of the adjacent resonant line, wherein a first pair of resonators of the plurality of resonators are capacitively coupled to each other on the side of the end-opened electrode of the at least one of the plurality of resonant lines, and a second pair of resonators of the plurality of resonators are inductively coupled to each other, the first pair of resonators including the at least one of the plurality of resonant lines, wherein the line width of the end-opened electrode is different from the line width of the short-circuit-end-side electrode along an entire length of the end-opened electrode, and wherein a sum value of the line width of the end-opened electrode and a dimension of a gap between the end-opened electrode and the short-circuit-end-side electrode on one side of the short-circuit-end-side electrode is larger than 0.5 times of a value calculated by subtracting the line width of the short-circuit-end-side electrode from the line width of the open-end-side electrode.

11. The microstripline filter according to claim 10, wherein the sum value of the line width of the end-opened electrode and the dimension of the gap between the end-opened electrode and the short-circuit-end-side electrode on one side of the short-circuit-end-side electrode is larger than 0.5 times of the line width of the open-end-side electrode.

* * * * *